US005131801A

United States Patent [19]

Melanson

[11] Patent Number: 5,131,801

[45] Date of Patent: Jul. 21, 1992

[54] FORKLIFT FORK TILT ANGLE INDICATOR

[75] Inventor: Clayton C. Melanson, Arlington, Tex.

[73] Assignee: Tandy Corporation, Fort Worth, Tex.

[21] Appl. No.: 624,857

[22] Filed: Dec. 10, 1990

[51] Int. Cl.[5] ..... B66F 9/20

[52] U.S. Cl. ..... 414/635; 33/366

[58] Field of Search ..... 414/628-638; 33/366, 370, 371, 376; 212/154

[56] References Cited

U.S. PATENT DOCUMENTS

| | | | |
|---|---|---|---|
| 2,916,172 | 12/1959 | Locke | 414/634 X |
| 3,049,257 | 8/1962 | Bertenshaw et al. | 414/635 |
| 3,564,531 | 2/1971 | Burgin | 33/366 X |
| 3,865,265 | 2/1975 | Brudi et al. | 414/635 |
| 3,883,021 | 5/1975 | Wilhelm | 414/634 |
| 4,452,078 | 6/1984 | Formanek et al. | 33/366 X |
| 4,511,974 | 4/1985 | Nakane et al. | 414/634 X |
| 4,516,117 | 5/1985 | Couture et al. | 212/154 X |
| 4,567,666 | 2/1986 | Neis et al. | 33/366 X |
| 5,011,358 | 4/1991 | Anderson et al. | 414/635 X |
| 5,031,329 | 7/1991 | Smalidge | 33/366 |

FOREIGN PATENT DOCUMENTS

| | | | |
|---|---|---|---|
| 524626 | 12/1953 | Belgium | 414/635 |
| 879918 | 4/1953 | Fed. Rep. of Germany | 33/366 |
| 385601 | 7/1934 | United Kingdom | 212/154 |
| 713324 | 8/1954 | United Kingdom | 414/635 |

*Primary Examiner*—David A. Bucci
*Attorney, Agent, or Firm*—Townsend and Townsend

[57] ABSTRACT

A device (38) for indicating to an operator (22) of a forklift (12) the tilt angle (32) of the tines (33) of the fork (28). The device includes a sensor (40) and an indicator display (42) which can be adjusted to a particular offset or calibrated to display the tilt angle of the forks.

7 Claims, 2 Drawing Sheets

FORKLIFT FORK TILT ANGLE INDICATOR

This invention relates to a device which indicates the tilt angle of the fork of a forklift, and more particularly, to an apparatus which allows for adjustment of the tilt angle of the fork to a preset tilt angle, typically horizontal, for picking up loads or tilting to an appropriate angle, e.g., pitched backwards so cylindrical objects such as pipes will not roll forwards off the front ends of the fork.

BACKGROUND OF THE INVENTION

Forklifts have long been used in warehouses and yards where inventory items are stored. A forklift usually has a vehicle frame and a fork assembly attached thereto with powered mechanisms to lift and position the fork. Forklifts have allowed efficient use of storage space in allowing stacking of fairly heavy objects on a minimum of floor space. This has allowed construction of warehouses with relatively small floor space but high storage capacity, thus keeping construction costs to a minimum.

Forklifts have allowed stacking of inventory on top of each other by providing access to the top levels of stacked objects. The fork on the forklift is designed to be able to reach heights of 10 or more feet and to reach up to the top and remove those objects quickly. Safety is provided, both for the person retrieving the objects and for the objects themselves.

The forklift usually has at least two fork tines which make up a fork which is slipped underneath objects which are stacked. The fork is then lifted to pick up the object. However, the fork must be positioned underneath the object to be able to lift it. This usually involves slipping the fork between successive stack layers.

Many different types of pallets have been designed for separating the layers of stacked inventory. The pallets often serve as both a support for the object and as a means for separating one layer of objects from the next thereby providing a space into which the fork may be inserted for picking up each layer. Conventional pallets are usually made of wood. These pallets are relatively expensive, heavy, take up space which could otherwise be used for storage, and are unwieldy to handle when the supported objects are removed.

An alternative pallet has been developed, called the SKEE pallet, made by Elberta Crate and Box, of Dundee, Illinois. SKEE pallets are typically made of flat paperboard and are similar to slip sheets. SKEE pallets, however, have one curved edge so that the pallet looks like a ski in profile. Two of these are usually used between layers of inventory with the curved tips pointing away from one another. This permits the fork of a forklift to slip between the SKEE pallets while minimizing the vertical space taken up by the pallets. This design provides features of low cost, space saving size and shape, and light weight. In particular, the SKEE pallets are far easier to manipulate in many circumstances but suffer from a substantial disadvantage: inserting the fork between stacked layers is far more difficult than with the wooden pallets.

Inserting the fork between SKEE pallets requires far greater care and precision than with wooden pallets. The fork tines are often tapered and polished, and may be lubricated. The fork must be positioned properly both with respect to height and, very importantly, with respect to the tilt angle of the fork so that it properly slips between the two SKEE pallets separating the stacked inventory. However, when the fork insertion is improperly performed, significant damage may occur to the pallets and to the stacked inventory if the tip of a tine pierces the pallet and engages the inventory.

SUMMARY OF THE INVENTION

The present invention provides a device for determining the tilt angle of the fork on a forklift. The device comprises a sensor and a display. Thus, a forklift operator will more easily be able to adjust the angle of the fork for slipping between stacked items for picking up the layer above the fork.

The fork height is generally determined visually from the operator position in the forklift. However, visual determination of the tilt angle of the fork from the operator's seat is difficult and requires significant experience for proper adjustment. The present invention substitutes for direct visual determination of the tilt angle of the fork and provides a display indicating the tilt angle.

The sensor is attached to the vehicle frame and the fork assembly for sensing the relative positions of these forklift components thereby providing a measurement which allows the accurate determination of the tilt angle of the fork. The device may provide means for adjusting the tilt sensor to compensate for a non-horizontal floor of the warehouse or yard. The sensor may measure the tilt angle relative to horizontal or may measure an angular or linear displacement which indirectly indicates the angular tilt of the fork. The sensor will typically be either a mechanical sensor, an electrical sensor, or an electromechanical sensor. The present invention also encompasses a forklift assembly or forklift including the device.

The present invention can also provide for indicating or signaling the forward or backward pitch of the fork. The indicator is typically a meter but may alternatively be any of a number of other types of indicators. The indicator may be a single light or a series of lights which change when the fork tilt angle crosses the boundaries of a preset range. The indicator may provide an audio signal which changes as it enters particular preset ranges. The limits of the preset ranges corresponding to a particular signal will preferably be subject to adjustment by an operator.

In another embodiment of the invention, an automatic mechanism is provided for adjusting a fork to a preset tilt angle. Thus, for example, a mechanism can be provided that, upon activation, automatically sets the fork to a preset tilt. Typically, the tilt will be horizontal or parallel with the floor. However, in certain embodiments the tilt may be either backwards for transport of, e.g., cylindrical objects such as pipes so they roll towards the back of the fork against a stop, or the column, or perhaps tilted forward for unloading goods from the fork. Means for providing each of these preset tilt angles by mere operation of separate buttons may be constructed.

Other features and advantages of the invention will appear from the following description in which the preferred embodiments have been set forth in detail in conjunction with the accompanying drawings.

DESCRIPTION OF THE PREFERRED EMBODIMENT

Figure 1:
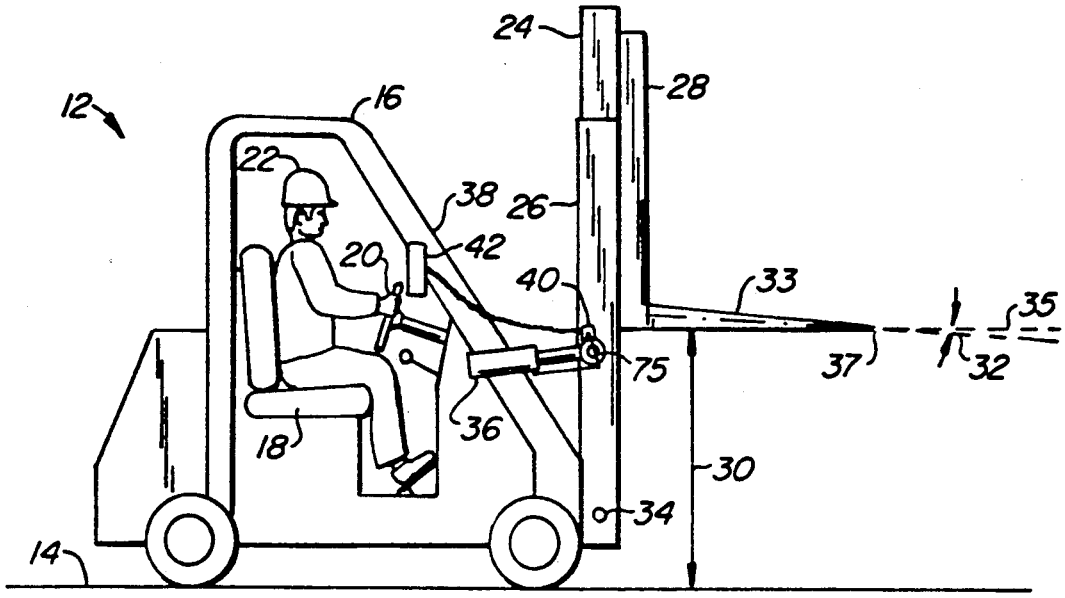
FIG. 1 illustrates a standard forklift incorporating the present invention.

Referring now to FIG. 1, a forklift 12 is illustrated. The forklift 12 operates on a floor 14. The forklift 12 has a vehicle frame 16 on which is mounted a seat 18 and a steering wheel 20 at which the operator 22 sits. Attached to the vehicle frame 16 is a forklift assembly 24 having a column 26 along which the fork 28 may be raised or lowered to a desired height 30. A tilt angle 32 of the tine 33 of fork 28, measured from a horizontal 35, is adjustable. A number of different mechanisms to adjust the tilt angle of the fork are available, but a preferred mechanism is with a pivot 34, coupling forklift assembly 24 to vehicle frame 16, and a piston 36, coupling vehicle frame 16 to column 26, which causes fork 28 to tilt as column 26 rotates about the pivot 34. The present invention provides a device 38 to indicate to the operator the tilt angle 32 of the fork 28, the device usually comprising a separate sensor 40 and an indicator display unit 42.

Wooden pallets are often used as supports and to separate stacked items by a space into which the fork is easily inserted. When so positioned, the fork may be raised to lift the pallet and items sitting thereon.

SKEE pallets, made by Elberta Crate and Box, of Dundee, Illinois, have replaced the standard wooden pallets for many applications. The SKEE pallet is made of wood, cardboard, or a thick plastic that usually has a curved front edge. The curved edge provides some guidance to the forks to deflect them to a proper position. Items are stacked with SKEE pallets between them in an orientation such that the curved edges extend away and opposite one another. See FIG. 2. The tip of the fork is positioned between the SKEE pallets and slid between them being partly guided by the curved front edges. The insertion between the pallets is usually effected by driving the forklift forward, so the fork slides between the pallets. Then, the fork is lifted to raise the upper pallet and the objects sitting thereon.

When articles are stacked upon one another, either using wooden pallets or SKEE pallets, inserting the fork between layers requires that the fork be properly positioned both with respect to height and tilt angle of the fork. The tilt angle of the fork is important for correct and trouble-free sliding under the pallet. With the wooden pallets, the fork is inserted into an opening in the pallet between two layers of the stacked objects. Since the space into which the fork is to be inserted is relatively large, the angle of insertion is not particularly critical. When the angle is incorrect, the rigidity of the pallet can cause the fork to get stuck or redirected to a proper angle. Compared to wooden pallets, the space between the SKEE pallets is very narrow, and the fork will slide in only if correctly positioned at a correct tilt angle.

Figure 2:
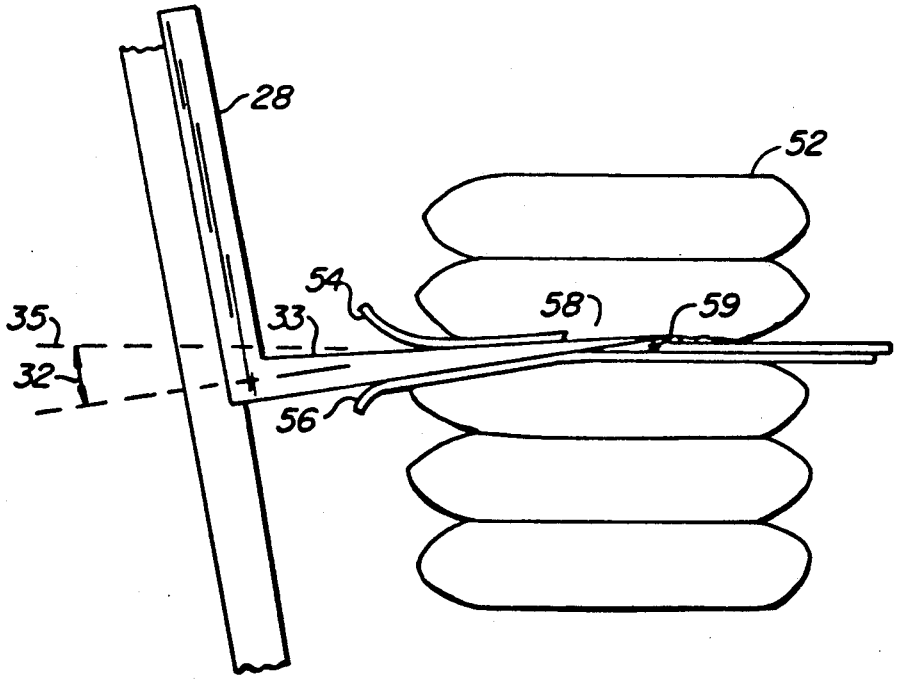
FIG. 2 illustrates how an upper SKEE pallet can be punctured or torn if the fork is tilted backwards when inserted between two SKEE pallets.

FIG. 2 illustrates a situation where objects 52 are stacked with a pair of pallets 54,56 between layers. The upper pallet 54 is positioned so its front surface curves up, while the lower pallet 56 is positioned so its front surface curves down. However, in the pickup process, problems will result when tines 33 of fork 28 are oriented with a sufficiently great tilt angle 32 upwards, or backwardly tilted, from horizontal 35. The fork 28 is initially positioned for insertion between the upper pallet 54 and the lower pallet 56. If improperly positioned, when the fork is moved forward to slip in, the upper layer of goods may be pushed off the lower layer, or the fork will tend to tear the pallet or be pushed up and pierce through the upper pallet forming a hole 58. This damages at least the pallet, and occasionally damages the objects 52 sitting thereon. A similar problem for the lower pallet can occur when the fork is tilted downwards and inserted between the pallets. In this situation, the fork is pushed downwards by the objects above and may pierce the lower pallet or damage the objects below.

Getting the tilt angle 32 correct for fork insertion between the SKEE pallets is critical and requires substantial practice. The height of the fork, particularly of the tips 37 of the tines 33, is determined visually by the operator while operating the forklift. The tilt angle adjustment is often a far more difficult process because the operator is not well positioned for visually determining the tilt angle.

As shown in FIG. 2, the range of error for the correct tilt is often very narrow. In practice, the actual range of error will depend upon the particulars of the sharpness of the tips 59 of the tines 33, the weight of the objects being lifted, the puncture strength of the SKEE pallet, as well as a number of additional parameters. For any particular combination of parameters, the acceptable range for angle 32 (assuming pallets 54,56 are horizontal) may be very narrow, such as 5°, to a more generous 20° or greater.

Having illustrated the environment and many of the problems associated with use of a forklift 12, the invention provides a device 38 for signaling to the operator 22 the tilt angle 32 to which the fork is set. FIG. 1 illustrates two basic elements of a device 38 provided herein, a sensor 40 which is operably coupled to a display 42. The sensor 40 is attached to the vehicle frame 16 and the forklift assembly 24, and measures a parameter which varies with the tilt angle 32 of the fork 28. The sensor 40 is operably coupled to the tilt angle indicator display 42 so the operator 22 can easily determine the tilt angle 32 of the fork 28.

The sensor 40 can, for instance, measure the separation of the piston ends, which may be directly correlated with the tilt angle of the fork. The sensor is typically a mechanical, an electrical, or an electromechanical sensor, but can be a pneumatic or hydraulic transducing mechanism. The sensor can also be indirectly coupled through a pneumatic or hydraulic system. The sensor 40 will usually be attached directly to the forklift assembly, e.g., the column 26 of the forklift assembly 24.

Another functional component usually part of the device 38 is the display 42. This display 42 will typically be within the operator compartment of the forklift but will more usually be in a convenient position so that the operator can easily watch it and the fork height simultaneously. The display 42 will usually be in a protected position to avoid damage from objects which may accidentally fall onto the forklift. Usually, the display will be a visual display. A suitable visual display is a meter which can display analog information on the tilt or a stepwise or digital meter which will indicate specific ranges. The display may be one or a series of lights which indicate when the fork is tilted up, is horizontal, and is tilted down. It may indicate any selected number of various preset ranges. In another embodiment, the display will be an audio indicator. Thus, a buzzer or tone or whistle or other detectable noise may be provided at particular tilt angles. For example, a tone of particular frequency may be provided when the fork is in a horizontal position. A variety of frequencies may provide indication of the tilt angle. An audio signal allows the operator to visually concentrate on height and other aspects of position without having to also focus on a visual display. As discussed above, and referring to FIG. 1, one way of varying the tilt angle 32 of the fork 28 is by use of a piston 36 which pivots the forklift assembly 24 about a pivot 34. Thus, the tilt angle 32 of the fork 28 can be determined by measuring the separation of the ends of the piston.

Figure 3:
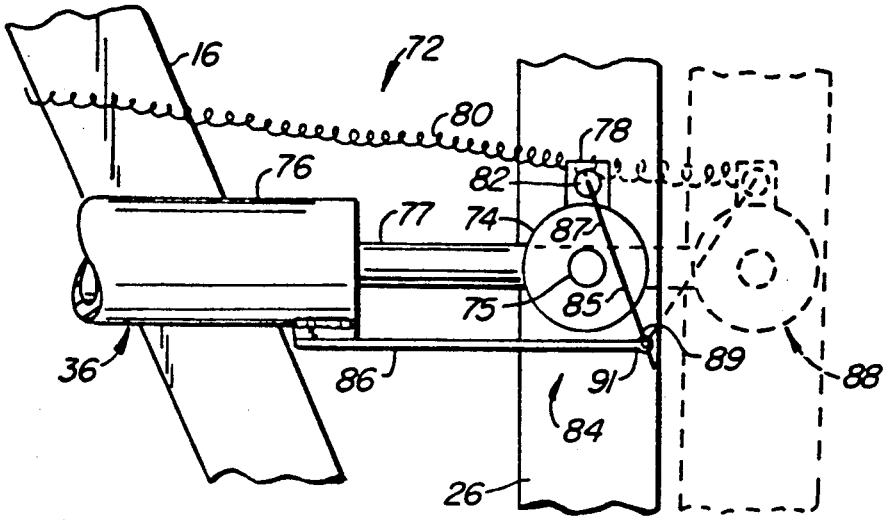
FIG. 3 illustrates a potentiometer mounted to a piston for sensing the extension of the piston which determines the tilt angle of the fork.

FIG. 3 illustrates a sensor mechanism 72 attached to a piston assembly 36. The piston assembly 36 has a yoke 74 secured to a pin 75 extending from column 26, a cylinder 76, and a connecting shaft 77 coupling yoke 74 and cylinder 76. A potentiometer 78 having a rotary shaft 82 is mounted to yoke 74. An extension 86 is rigidly secured to and extends from cylinder 76. A connector 85 has a first end 87 fixed to shaft 82 and a second end 89 slidably connected to the distal end 91 of extension 86. Actuation of piston assembly 36 causes yoke 74 to move, e.g., between the solid line and dashed line positions of FIG. 3 thus rotating shaft 82 of potentiometer 78. The potentiometer 78 is operably connected to display 42 by a line 80.

Figure 4:
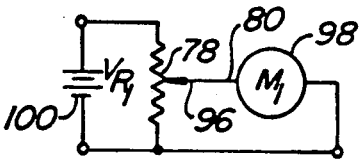
FIG. 4 illustrates a circuit schematic of one embodiment of a device of the present invention.

FIG. 4 illustrates tilt angle device 38 as a simplified electrical schématic. Wiper arm 96 of potentiometer 78 is shown coupled to a meter 98. A voltage source 100 is placed across potentiometer 78 while meter 98 is coupled to line 80 and ground. Meter 98 and voltage source 100 are components of display unit 42 to provide the operator an indication of the angular orientation 32 of tines 33.

Figure 5:
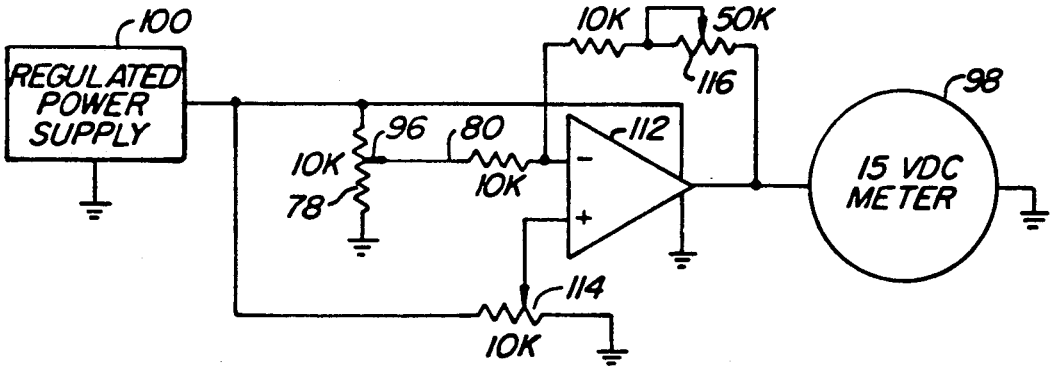
FIG. 5 illustrates a circuit schematic of an embodiment of a device of the present invention.

FIG. 5 is a more detailed schematic of device 38. Voltage source 100 is a regulated voltage source to eliminate voltage changes due to operating conditions, temperature, and so forth. An operational amplifier 112, such as made by Tandy Corporation of Fort Worth, Texas as part no. 276-007, is used to provide an amplified signal to meter 98. A 10KΩ variable resistor 114 is used to zero out operational amplifier 112 while a 50KΩ variable resistor 116 is used to adjust the amplification of operational amplifier 112 according to the sensitivity desired. All resistors are 10KΩ resistor, with the exception of resistor 116. Zeroing resistor 114 can be used to adjust meter 98 for horizontal. In some situations pallets 54,56 may not be horizontal, such as when floor 114 is not horizontal. In these situations angle 32 will be measured from the angular orientation of pallets 54,56.

An alternative embodiment may be constructed where the potentiometer or variable resistor and the connector are mounted in the reverse orientation. In another alternative embodiment, a linear resistor or similar electrical component may be mounted on either end of the piston with a connector between the two ends which moves back and forth relative to the separation of the piston. Again, the device can be designed to be adjusted or offset to indicate to the operator when the fork is horizontal. This adjustment may be mechanical, by displacement of the sensor, or by an electrical or other offsetting means. At separations other than when the fork is horizontal a display may provide means for indicating the tilt angle. Although particular embodiments are described using either rotary or linear sensor devices, many others will be apparent to one skilled in the art.

Besides direct attachments of the electrical sensor device to the fork column and vehicle frame, a mechanical or other apparatus may provide for a remote location of the sensor. For example, rather than measuring the separation of the piston ends at the piston, the relative separation can be determined at another point on the column. A mechanical linkage or hydraulic or pneumatic system may be coupled to a sensor located at a remote position.

Figure 6:
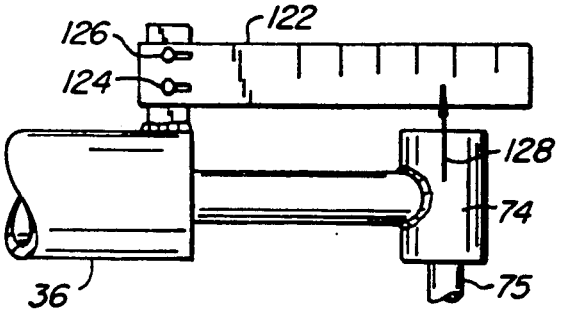
FIG. 6 is a top view illustration of a simple mechanical tilt angle indicator.

FIG. 6 is a top view illustration of a particularly simple embodiment of the present invention. An indicator 122 is attached to one end of the tilt angle controlling cylinder 36 by screws 124 passing through slots 126 formed in indicator 122. Yoke 74, attached to pin 75 has a pointer 128 mounted thereto which points to positions on the indicator 122. The position of the indicator can be adjusted using screws 124 and slots 126 for offset. This embodiment provides a particularly simple analog indicator.

Besides a signaling system for determining the tilt of the forks, a feedback or other system may be provided to automatically adjust the tilt angle of the forks to a particular tilt. For example, a mechanism can easily be devised such that the fork will automatically be set to a preset tilt upon activation of the mechanism. A horizontal tilt setting may be achieved by activating a single button and the operator then needs only adjust the height of the fork for correct positioning to insert the fork under the object to be picked up. In another embodiment, the mechanism can be adjusted to automatically tilt backwards by a set amount when either carrying an object or moving other objects which might roll or move forwards or backwards along the fork. For example, pipes which would otherwise roll off the front of the fork may be easily handled after being picked up by pressing a button which automatically sets the fork to tilt backwards and at a defined rate, so the pipe will slowly roll back on the fork. This mechanism can also be used for tilting the fork forwards for placing an object onto the floor or on top of another object. Then by merely pushing a single button, the operator may tilt the forks forward and place the object in a correct position without manually controlling the tilt of forks. These automatic mechanisms could be adjustable to preset tilts or to work on a non-horizontal floor.

Other modifications and variations can be made to the disclosed embodiments without departing from the subject of the invention as defined by the following claims.

What is claimed is:

1. A device for determining the angular orientation of a fork on a forklift, the forklift including a frame, a fork assembly having a fork, the fork assembly pivotally attached to the frame, a piston assembly attached to the frame, the piston assembly having a connecting shaft and a cylinder, the connecting shaft having one end longitudinally movable within the cylinder and a second end pivotally coupled to the fork assembly, the device comprising:

an extension rigidly attached to the cylinder at a first extension end, the extension extending longitudinally parallel to the cylinder axis and terminating at a second extension end;

a connector having first and second connector ends, the first connector end drivingly connected to the second extension end;

a potentiometer rigidly attached to the fork assembly, the potentiometer comprising a rotating element rigidly attached to the second connector end; and an indicator electrically coupled to the potentiometer for providing an operator with a measure of the angular orientation of the fork relative to the frame.

2. A device of claim 1, wherein a range of angular orientations is centered around an angular orientation corresponding to the fork being parallel to a floor on which the forklift lies.

3. A device of claim 2, wherein the range of angular orientations is ±20°.

4. A device of claim 1, wherein the indicator comprises a visual display.

5. A device of claim 1, wherein the indicator comprises an audio signal.

6. A device of claim 1, wherein the first connector end is pivotally and slidably connected to the second extension end.

7. A device for determining the angular orientation of a fork on a forklift, the forklift including a frame, a fork assembly having a fork, the fork assembly pivotally attached to the frame, a piston assembly attached to the frame, the piston assembly having a connecting shaft and a cylinder, the connecting shaft having one end longitudinally movable within the cylinder and a second end pivotally coupled to the fork assembly, the device comprising:

an extension rigidly attached to the cylinder at a first extension end, the extension extending longitudinally parallel to the cylinder axis and terminating at a second extension end;

a connector having first and second connector ends, the first connector end pivotally and slidably connected to the second extension end;

a potentiometer rigidly attached to the fork assembly, the potentiometer comprising a rotating element rigidly attached to the second connector end; and an indicator electrically coupled to the potentiometer for providing an operator with a measure of the angular orientation of the fork relative to the frame, the indicator comprising a visual display, the visual display having a horizontal indicator which indicates the fork is parallel to a floor on which the forklift rests, the visual display having a range of ±20° from the horizontal indicator.

* * * * *